United States Patent [19]

Carlsson

[11] Patent Number: 4,579,172

[45] Date of Patent: Apr. 1, 1986

[54] PLATE HEAT EXCHANGER AND EDGE SEAL

[75] Inventor: Bengt Carlsson, Vargön, Sweden

[73] Assignee: Reheat AB, Taby, Sweden

[21] Appl. No.: 591,374

[22] Filed: Mar. 20, 1984

[30] Foreign Application Priority Data

Apr. 8, 1983 [SE] Sweden ..... 8301951

[51] Int. Cl.[4] ..... F28F 3/10

[52] U.S. Cl. ..... 165/167; 165/166

[58] Field of Search ..... 165/166, 167

[56] References Cited

U.S. PATENT DOCUMENTS

| | | | |
|---|---|---|---|
| 2,912,749 | 11/1959 | Bauernfeind et al. | 165/167 |
| 3,610,331 | 10/1971 | Schreiber | 165/166 |
| 4,162,703 | 7/1979 | Bosaeus | 165/167 |

FOREIGN PATENT DOCUMENTS

| | | | |
|---|---|---|---|
| 68581 | 2/1949 | Denmark | 165/166 |
| 643121 | 3/1937 | Fed. Rep. of Germany . | |
| 849444 | 11/1939 | France | 165/167 |
| 1301389 | 7/1962 | France | 165/166 |
| 138784 | 7/1978 | Norway . | |
| WO83/00736 | 3/1983 | PCT Int'l Appl. | 165/166 |
| 165435 | 11/1958 | Sweden . | |
| 181501 | 6/1922 | United Kingdom | 165/166 |
| 297589 | 9/1928 | United Kingdom | 165/166 |
| 513589 | 11/1939 | United Kingdom | 165/167 |
| 1223752 | 3/1971 | United Kingdom | 165/167 |

*Primary Examiner*—William R. Cline
*Assistant Examiner*—John K. Ford
*Attorney, Agent, or Firm*—Cushman, Darby & Cushman

[57] ABSTRACT

The invention relates to a plate heat exchanger of the type provided with plates (1,1) attached in pairs sealingly to each other, between which pairs of plates in the assembled state of the heat exchanger, gaskets (6) extend in grooves (3,4) embossed in the plates. The plates (1,1) attached in pairs to each other are connected to each other in the edge areas to be connected by a sealing folding (5,7), which extends inward between the individual plates and in between the embossings facing toward each other in the two plates and forming the grooves (3).

4 Claims, 2 Drawing Figures

PLATE HEAT EXCHANGER AND EDGE SEAL

BACKGROUND OF THE INVENTION

This invention relates to a plate heat exchanger of the type comprising plates, which are joined in pairs closely adjacent each other and provided with corrugations forming passageways for the media flowing through the plate heat exchanger.

The plates joined in pairs closely adjacent each other are provided with grooves about their circumference and about the inlet and outlet portions. The grooves are intended to receive the gaskets, which in assembled state of the heat exchanger are pressed sealingly between the respective plate pair, thereby preventing leakage from the heat exchanger and distributing the media in the inlet and outlet portions.

At the type of plate heat exchanger comprising single plates, a gasket is attached between the plates, whereby each plate and therewith its gasket groove automatically rests against the gasket located behind in the assembled heat exchanger. At the heat exchanger comprising plates, which are arranged in pairs and already at the manufacture joined to each other, no gasket is provided between these two plates and, therefore, there is no support between them in the area of the gasket grooves. This involves the risk, that leakage arises in the heat exchanger between adjacent pairs of plates, due to the fact that the plates comprised therein and their gasket grooves can be pressed in against each other, for example at the mounting or due to the working pressure prevailing in the media in the heat exchanger.

When the joint between the two plates comprised in the pair is an edge weld or an outward directed folding, the space, which is located inside between the plates and compared to the heat exchanger with single plates has no gasket, permits a relatively free flow of the medium flowing between the plates arranged in pairs. This space, thus, acts in principle as a shunt line and lowers the effeciency degree of the heat exchanger.

SUMMARY OF THE INVENTION

The present invention as it is defined in the characterizing clauses of the attached claims renders it possible to eliminate the leakage problems between the plate packages arranged in pairs and at the same time to reduce the shunt effect of said space.

The invention relates to a plate heat exchanger of the type provided with plates (1,1) attached in pairs sealingly to each other, between which pairs of plates in the assembled state of the heat exchanger, gaskets (6) extend in grooves (3,4) embossed in the plates. The plates (1,1) attached in pairs to each other are connected to each other in the edge areas to be connected by a sealing folding (5,7), which extends inward between the individual plates and in between the embossings facing toward each other in the two plates and forming the grooves (3).

BRIEF DESCRIPTION OF THE DRAWING

The invention is described in greater detail in the following by way of example and with reference to the accompanying drawing, in which.

DETAILED DESCRIPTION

As should have become apparent without saying, the plates here concerned are comprised in a plate heat exchanger, which comprises a plurality of plate elements, which in advance have been sealingly joined to each other in pairs, and between which gaskets are provided. Said elements are clamped between two stand plates in a stand. This constitutes prior art and will not be described here in greater detail.

Figure 1:
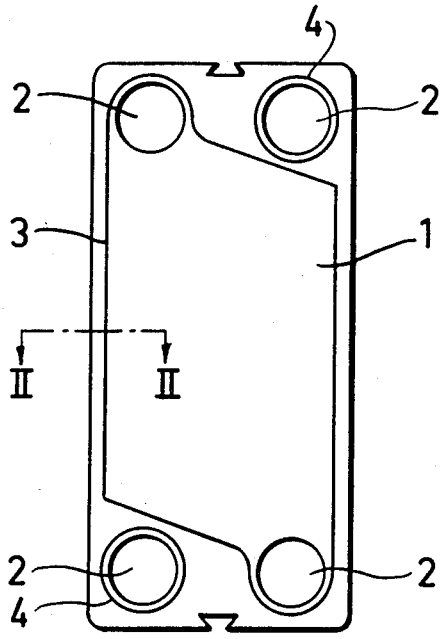
FIG. 1 is a general end side view of a plate package comprising a number of plates joined to each other in pairs to form a plate heat exchanger.
Figure 2:
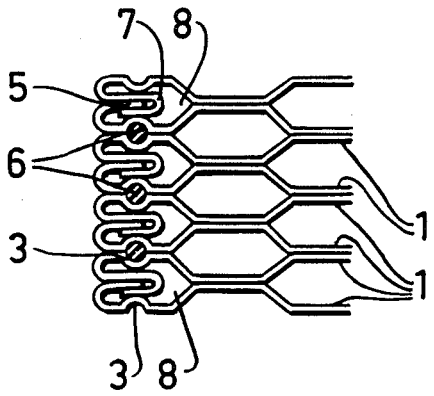
FIG. 2 is a schematic partial section through the package according to FIG. 1 along the line II—II.

The heat exchanger plate 1 shown in FIG. 1 is provided in usual manner with inlet and outlet openings 2 and includes grooves 3 for field gaskets 6 extending about the circumference of the plate and the inlet and outlet opening of one medium, and grooves 4 for circular gaskets enclosing the inlet and outlet openings of the second medium. The heat exchanger plates 1 as mentioned above are sealingly jointed to each other in pairs along the circumference and along the edges of the inlet and outlet openings in question. According to the invention, this jointing is effected by folding inward the edges of the two plates 1 forming the pair, see FIG. 2. At said jointing one plate 1 at the edge is folded inward by a single folding 5 while the second plate is folded with a double inward folding 7, which embraces the free edge folded inward of the first plate 1. This is clearly shown in FIG. 2. The joint or folding extends inward between the individual plates in the pair a sufficient distance, so that the joint forms a support between the grooves 3 embossed in the plates. The gaskets 6 attached between the plate pairs 1,1 hereby can be pressed together with a sufficient force for bringing about a satisfactory and reliable sealing between adjacent plate pairs.

The aforementioned space 8 formed between the plates 1,1 of the pairs is filled partially by the joint or folding. The flow resistance in this space, therefore, is substantially increased, whereby shunting of the medium between the plates is substantially prevented.

Due to the fact that the joint is an inward directed folding of the plates, and the folding has been given the configuration described, the joint at increasing pressure between the pair of plates automatically is affected in sealing direction, i.e. pressed together. Hereby a further advantage of the present invention is obtained, as the pressure prevailing between the plate pairs does not tend to "burst" the joint.

In connection with the folding operation, a sealing agent can be applied in usual manner in the folding area of the plates.

The invention has been described above in principle. It is possible within its scope to carry out the folding for jointing the plates in other ways, but with regard paid to the above criteria.

What I claim is:

1. A plate heat exchanger of the type comprising plates sealingly attached to each other in pairs, between which plate pairs in an assembled state of the heat exchanger gaskets extend in grooves embossed in the plates, characterized in that the plates attached in pairs to each other are connected to each other in edge areas by a sealing folding, which extends inward between the individual plates and inward between the embossings facing toward each other in the two plates and forming said grooves.

2. A plate heat exchanger as defined in claim 1, characterized in that the folding consists of a single inward folding made in one plate and of a folding made in the second plate in parallel with said inward folding and extending in the same direction and of a subsequent folding about the free edge of said inward folding.

3. A plate-type heat exchanger, comprising:

a plurality of plates having respective outer perimetrical margins, these plates being arranged in a series, in confronting relation, in pairs;

means defining a perimetrical groove in each plate generally ringing the outer perimetrical margin thereof, each such groove opening in an axial direction relative to said series and, on each pair of plates, being externally concave and having internally convex sides in relation to the plates of that pair and participating in providing a space within each pair of plates, axially between the respective grooves on the two plates of that pair; from pair to adjoining pair among said pairs of plates in said series, the grooves being of corresponding placement so as to provide pairs of corresponding, confronting grooves;

a sealing gasket received in each such pair of corresponding, confronting grooves for sealing between the respective adjoining pairs of plates; and means sealingly attaching the two plates of each said pair to one another, including the two plates of each pair being marginally folded over in a doubling sense, to such an extent that edge portions of the two plates lie between, and axially fill said space between and, as a set, are engaged between the respective two groove convex internal sides.

4. The plate-type heat exchanger of claim 3, wherein:

within each pair of plates, one is marginally folded in a doubling sense but once, so that its edge portion points medially inwards of the heat exchanger and is axially spaced from both said respective two groove convex internal sides, leaving two gaps, and the other is marginally folded in a doubling sense once so that it extends medially inwards through and fills one of these gaps, and a second time so that it curls around the edge portion of the respective said one plate and extends laterally outwards through and fills the other of these gaps.

* * * * *